US007418739B2

(12) United States Patent
Chan

(10) Patent No.: US 7,418,739 B2
(45) Date of Patent: Sep. 2, 2008

(54) MULTIPURPOSE GARMENT

(76) Inventor: Agnes Chan, 89 Porter Street, Eltham, Victoria (AU) 3095

( * ) Notice: Subject to any disclaimer, the term of this patent is extended or adjusted under 35 U.S.C. 154(b) by 58 days.

(21) Appl. No.: 10/555,119

(22) PCT Filed: Apr. 30, 2004

(86) PCT No.: PCT/AU2004/000557

§ 371 (c)(1),
(2), (4) Date: Nov. 1, 2005

(87) PCT Pub. No.: WO2004/098330

PCT Pub. Date: Nov. 18, 2004

(65) Prior Publication Data

US 2007/0028342 A1 Feb. 8, 2007

(30) Foreign Application Priority Data

May 5, 2003 (AU) ..... 2003902153
Sep. 25, 2003 (AU) ..... 2003905232
Oct. 27, 2003 (AU) ..... 2003100886

(51) Int. Cl.
*A41D 13/04* (2006.01)
*A45F 4/00* (2006.01)
*A45C 15/00* (2006.01)

(52) U.S. Cl. ..... 2/48; 2/51; 224/577

(58) Field of Classification Search ..... 2/48, 2/49.1–49.5, 46, 47, 50, 51, 52, 88, 104, 2/174, 89, 69, 69.5, 94, 102, 92; 224/577, 224/578, 581, 586, 575, 153, 579, 580, 600; D2/860–864; 383/4; 190/107
See application file for complete search history.

(56) References Cited

U.S. PATENT DOCUMENTS

| | | | | | |
|---|---|---|---|---|---|
| 1,135,833 | A * | 4/1915 | Morse | 2/48 |
| 1,797,208 | A * | 3/1931 | Weisz | 2/51 |
| 1,970,307 | A * | 8/1934 | Hartmann | 2/48 |
| 2,364,258 | A * | 12/1944 | Wallace | 2/92 |
| 2,389,596 | A * | 11/1945 | Charnas et al. | 224/623 |
| 2,466,208 | A * | 4/1949 | Chanslor et al. | 2/48 |
| 2,616,598 | A * | 11/1952 | Sexton | 2/48 |
| 2,846,685 | A * | 8/1958 | Ehrich | 2/51 |
| 4,483,469 | A * | 11/1984 | Arisland | 224/582 |
| 4,535,878 | A * | 8/1985 | Grahl | 190/1 |
| 5,244,278 | A * | 9/1993 | Robitaille | 383/4 |
| 5,509,141 | A * | 4/1996 | Saltzman | 2/49.2 |
| 5,941,437 | A | 8/1999 | Okumura | 224/585 |
| 6,839,907 | B2 * | 1/2005 | Katz | 2/48 |

FOREIGN PATENT DOCUMENTS

FR 2 248 001 5/1975

* cited by examiner

*Primary Examiner*—Amy B Vanatta
(74) *Attorney, Agent, or Firm*—Kusner & Jaffe

(57) ABSTRACT

The present invention relates to an article of clothing which has multi purpose and function. The present invention is in one form a reversible pocketed apron that converts into a general carry bag and a storage bag. The apron can be worn in several ways. The pockets are used for holding and storing items, tools and accessories. The apron can be further folded into a storage bag for convenient carry. The apron has at least one large rear pocket which forms main compartment of the bag and has carry handles on the pocket. A bib portion is provided which is retractable away from the pocket.

24 Claims, 5 Drawing Sheets

MULTIPURPOSE GARMENT

FIELD OF INVENTION

The present invention relates to clothing articles, such as garments and/or aprons, which has multi purpose use. In one aspect, the present invention provides an apron which can be worn by a user in several ways, and alternatively, provides a carry bag/backpack which can be used to carry general goods and/or a storage bag for holding, storing and carrying, items, tools and accessories.

It will be convenient to hereinafter describe the invention in relation to a multipurpose garment; however it should be appreciated that the present invention is not limited to that use only.

BACKGROUND ART

A number of attempts have been made in the prior art to provide multipurpose bags.

One example is disclosed in JP 2002061011 which discloses an apron capable of being transformed into a bag different in shape from the apron. However, in carrying out the transformation process from an apron to a carry bag, the design requires a number of straps or handles to be dislodged and relocated. Furthermore, the apron must be folded and clipped together in a particular manner in order to form the carry bag itself. These transformation processes are considered to be relatively complicated, and involve a relatively high level of dexterity on the part of the user to make the transformation from apron to carry bag and vis versa.

Another example is FR 2 248 001 which also discloses an apron which can be transformed into a bag. However, the design of the apron is such that the size of the bag is limited in comparison to the flap of the apron which is folded over the bag. Further, alternate, uses of the apron or bag are not considered possible due to the design disclosed.

U.S. Pat. No. 5,941,437 discloses a stroller bag which can be also converted into a carry bag. However, the bag is designed in a manner which is not considered practical nor fashionable as an apron. The design does not afford substantial protection to the user when it is worn as it's coverage is relatively limited.

Still another example is U.S. Pat. No. 6,530,089 which discloses an adjustable garment protector, which may also be fabricated as a convertible food bag. However, the food bag provided is also disposable which limits its ability to be reused. It is considered to be not suitable for carrying general goods, such as grocery items, as the bag does not have suitable handles and is adapted to provide a closed bag with a lid. This is considered to limit the use of the bag provided in this disclosure.

There is still considered to be a need for a multi-purpose garment, such as an apron which can be transformed into a carry bag.

It is an object of the present invention to alleviate at least one disadvantage of the prior art.

Any discussion of documents, devices, acts or knowledge in this specification is included to explain the context of the invention. It should not be taken as an admission that any of the material forms a part of the prior art base or the common general knowledge in the relevant art in Australia or elsewhere on or before the priority date of the disclosure and claims herein.

SUMMARY OF INVENTION

The present invention provides, in one aspect, a clothing article, being adapted for multi purpose use, the first use being a carry bag and the second use being a garment protector, the article comprising a first body portion having attached thereto an additional panel forming a closable pouch between the panel and the first portion, the pouch being adapted, in use, to have goods placed therein, a bib portion having a strap adapted for placement around the neck of a user and being adapted to support the article, the bib portion being retractable in a direction towards the first body portion, and a second portion disposed intermediate the first portion and the bib portion.

The present invention also provides, in another aspect, a method of transforming an article of clothing being a garment protector into a carry bag, the article having a first body portion having attached thereto an additional panel forming a pouch between the panel and the first portion, the pouch being adapted, in use, to have goods placed therein, a bib portion and disposed intermediate the first portion and the bib portion is a second portion, the method comprising the steps of retracting the bib portion and the second portion toward the first portion and away from the pouch and releasably securing the bib portion to the first portion.

In another aspect, the present invention provides an article substantially as herein disclosed.

In yet another aspect, the present invention provides a method of transforming an article as herein disclosed.

Other aspects and preferred aspects are disclosed in the specification and/or defined in the appended claims, forming, a part of the description of the invention.

In essence, the present invention provides a design which is considered very useful. When converted to a bag, the present invention enables various goods to be transported and when converted to an apron, the apron can be used for general purposes, such as for substantially protecting a portion of the clothing of a user. An example of the use of the Apron Carry Bag of the present invention is at a barbeque or picnic. Foods, drinks, cutlery can be carried by the present invention to the barbeque or picnic site, emptied out of the bag, the bag can be then converted to one of several types of reversible aprons for the food preparation. School children could use the convertible bag to carry art or craft work materials and then later convert the Apron Carry Bag to a form of protective garment such as an apron while working on their project. The present invention provides, in one form, a reversible Apron Carry Bag, in the form of a reversible pocketed apron that also converts to a general goods carrying bag. The present invention provides a garment which comprises, in one form, an apron which has pockets for holding various items and can also be converted to a general carry bag/backpack. The carry bag can be carried in two ways. It can be used as a general carry bag by means of the handles or turn into a backpack by using the waist strap as a back shoulder strap.

The pockets are capable of holding tools and accessories for storage. The apron may be folded and securely closed by mean of releasable coupling into a storage bag. The waist strap is then used as a shoulder strap by attaching the buckle end to the snap connection.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

Further disclosure, objects, advantages and aspects of the present application may be better understood by those skilled in the relevant art by reference to the following description of preferred embodiments taken in conjunction with the accompanying drawings, which are given by way of illustration only, and thus are not limitative of the present invention, and in which.

DETAILED DESCRIPTION

Figure 1:
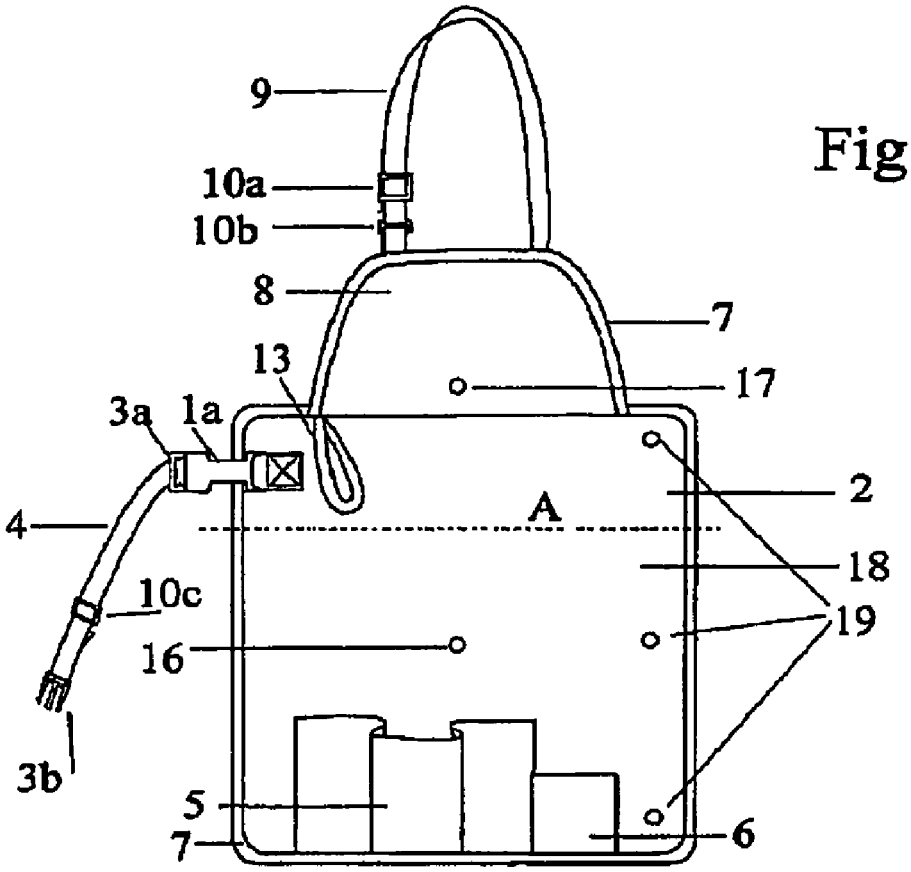
FIG. 1 illustrates a front view of the garment of the present invention configured for use as an apron.
Figure 10:
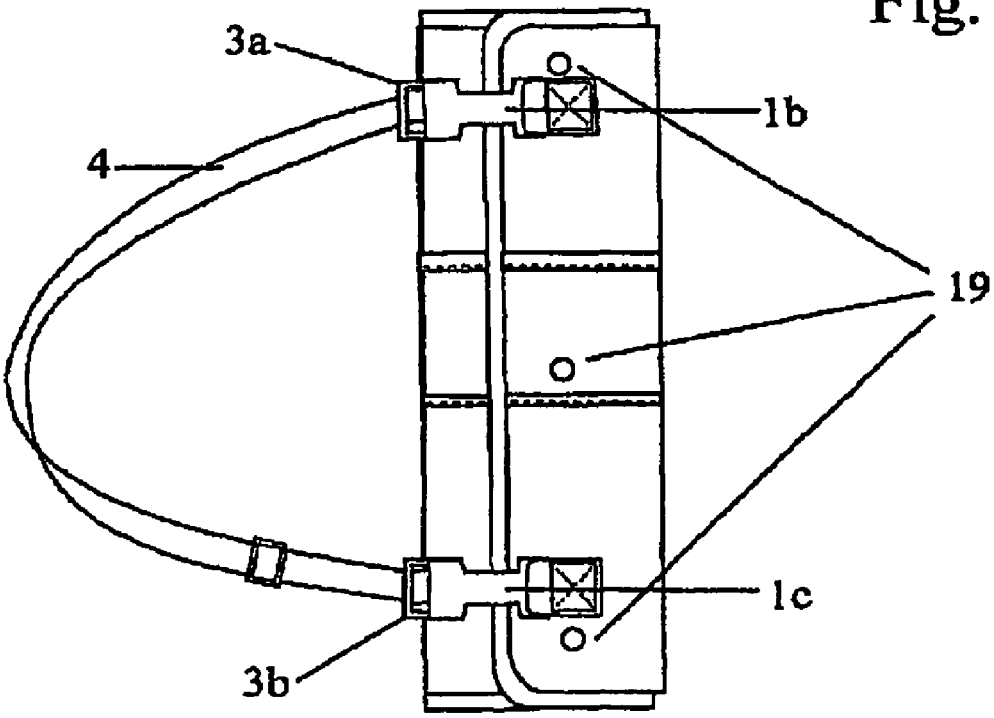
FIG. 10 illustrates the carry bag folded upon itself where it is secured for storage and shoulder carry strap showing.

Referring to FIG. 1, there is shown an apron carry bag which is adapted to be reversible, thus in one form serve as a work apron (FIG. 1) and in another form capable of being converted to a general carry bag (FIG. 5), a back pack (FIG. 8) and a storage bag (FIG. 10).

The apron has three portions, namely 8 bib portion 8, a first or body portion 18 and a foldable or second portion 2.

A neck strap (9) is provided for supporting the garment around the neck of a user. An adjustment means 10*a* is provided to adjust the length of the strap. The adjustment means can be any type of attachment or adjustable means such as a pair of hooks, Velcro fasteners, snaps, clips or buckles. The, the neck strap may be of two separate straps, which are attachable to each other. A front bib panel 8 is adapted to act as a part of the garment which functions to cover or shield a part of a user's body, such as the chest or bib 8 may be detached from second portion 2 or folded onto panel 2 and the garment worn as waist apron.

The garment may have reinforced edging in the form of a reinforcing ribbing 7.

In the embodiment shown, the bib portion is attached (or may be releasably secured to the foldable or second portion 2.

Figure 2:
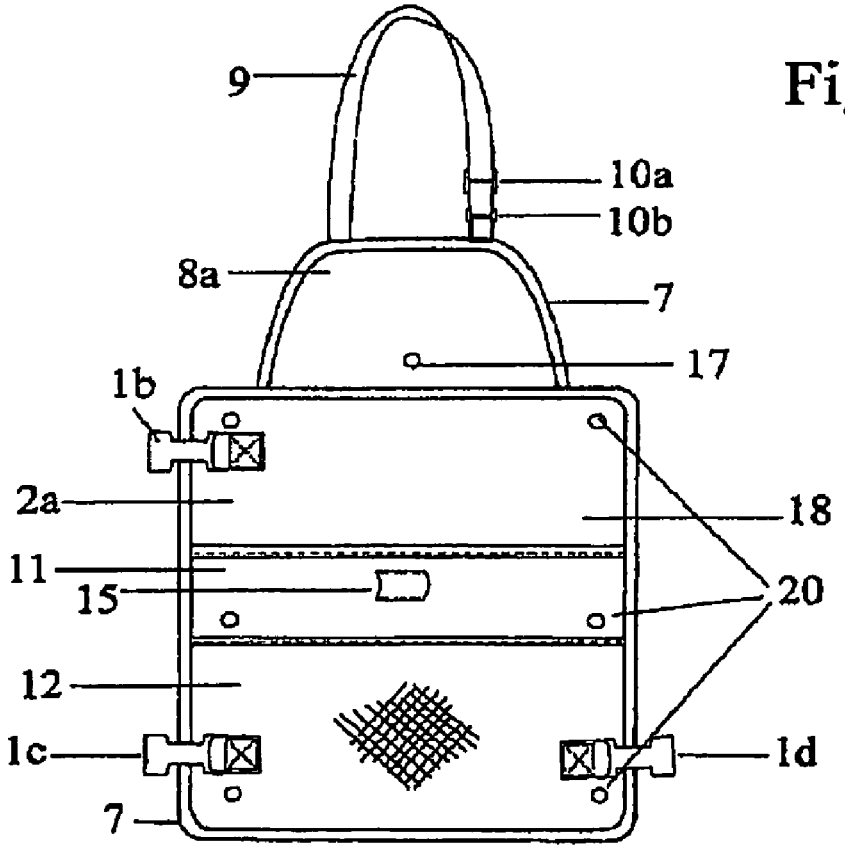
FIG. 2 illustrates a rear view of the garment of the present invention configured for use as an apron.

The second portion 2 has attached detachable waist strap 4, snap connection 1*a* and buckled end 3*a*, also with an additional buckle end 3*b* and an adjustable means 10*c*, for coupling, in use, around the body or waist of a user for figment with a snap connection 1*b* on FIG. 2.

Sewn on front face of the second portion 2 may be a towel strap loop 13 providing a means by which, in use, a user can attach a towel to the garment.

Also sewn on face of front panel 18 may be a number of pockets 5 and 6. The pockets 5 and 6 may be of any suitable size, shapes and configurations. Some of the pockets may include extra inner or outer and open or closable pockets within them, however they are illustrated in FIG. 1 as being suitable for carrying barbeque and other similar utensils. Thus a number of smaller pockets 5 are provided as well as a larger pocket 6.

Also shown on the front panel 18 are 3 units of releasable coupling 19, attached and corresponding releasable couplings 20 attached to the panel 2*a*, 11, and 12 as in FIG. 2. The releasable coupling can be of any quantity and means of attachment such as a pair of hook, Velcro fasteners, snaps, clips or buckles. The releasable couplings serve to assist the present invention to be configured to a number of various uses.

In FIG. 1, there is also shown a releasable coupling 16 attached to the first portion 18 and a corresponding releasable coupling 17. The couplings 16 and 17 are used to hold the second portion in a hold-away position when the apron is configured to a carry bag, as will be described in more detail below.

In FIG. 2, a rear view is shown of the garment disposed as an apron. A rear view 8*a* of the bib portion is shown together with the rear view 2*a* of the second portion. The rear view (not shown) of the first portion of the garment body is obscured by an additional panel 11. The additional panel 11 is attached to the first portion and between them they form a pouch which also has a duel purpose, that of the means by which a user can place goods and have the present invention act as a carry bag. Preferably, the panel 11 is of a size substantially similar to the first portion 18, however, the panel may be of any size, shape and configurations. The size of the panel 11 serves to determine the size of the carry bag pouch.

An additional pouch may be formed between the panel 11 and further panel 12. Preferably, the further panel 12 is a mesh however it may also be a panel of any material or similar material as that of the garment. The further pouch may be of any suitable size, shape and configurations.

The adjustable neck strap 9 and adjustment clip 10*a* and 10*b* is also shown. In use, a user would preferably place the neck strap 9 around their neck, with the panels 11 and 12 facing their body. Obviously, the apron may alternatively be used in the reverse, where the panels 11 and 12 are provided generally away from the body of the user.

The snap connection 1*b* on FIG. 2 for coupling to buckle end 3*b* of waist strap 4 on FIG. 1, in use, around body or waist of a user.

Figure 8:
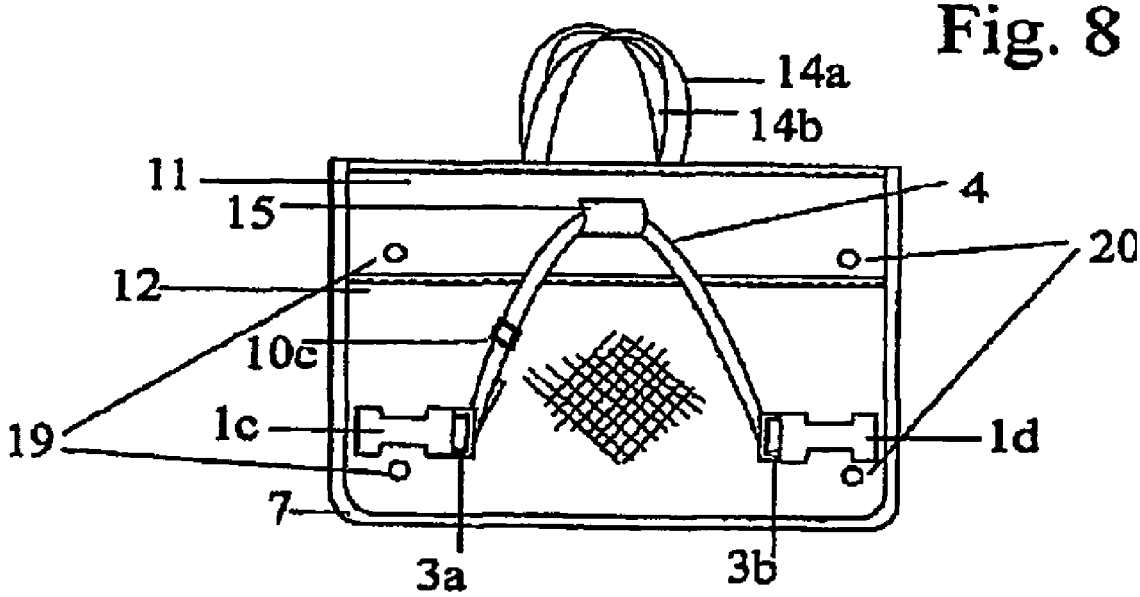
FIG. 8 illustrates a rear view of the carry bag, according to the present configured, but with back shoulder strap showing forming a backpack.

FIG. 8 shows a loop 15 attached to panel 11 and a pair of releasable snap connections 1*c* and 1*d* attached to panel 12. The purpose of the loop 15 is to hold/support the detachable waist strap 4, and engage the buckle end 3*a* and 3*b* to the snap connection 1*c* and 1*d*. When the buckled and 3*a* and 3*b* is coupled to the snap connection 1*c* and 1*d*, the waist strap 4 provides a back shoulder strap enable a user to configure the present invention in the form of a backpack.

Figure 3:
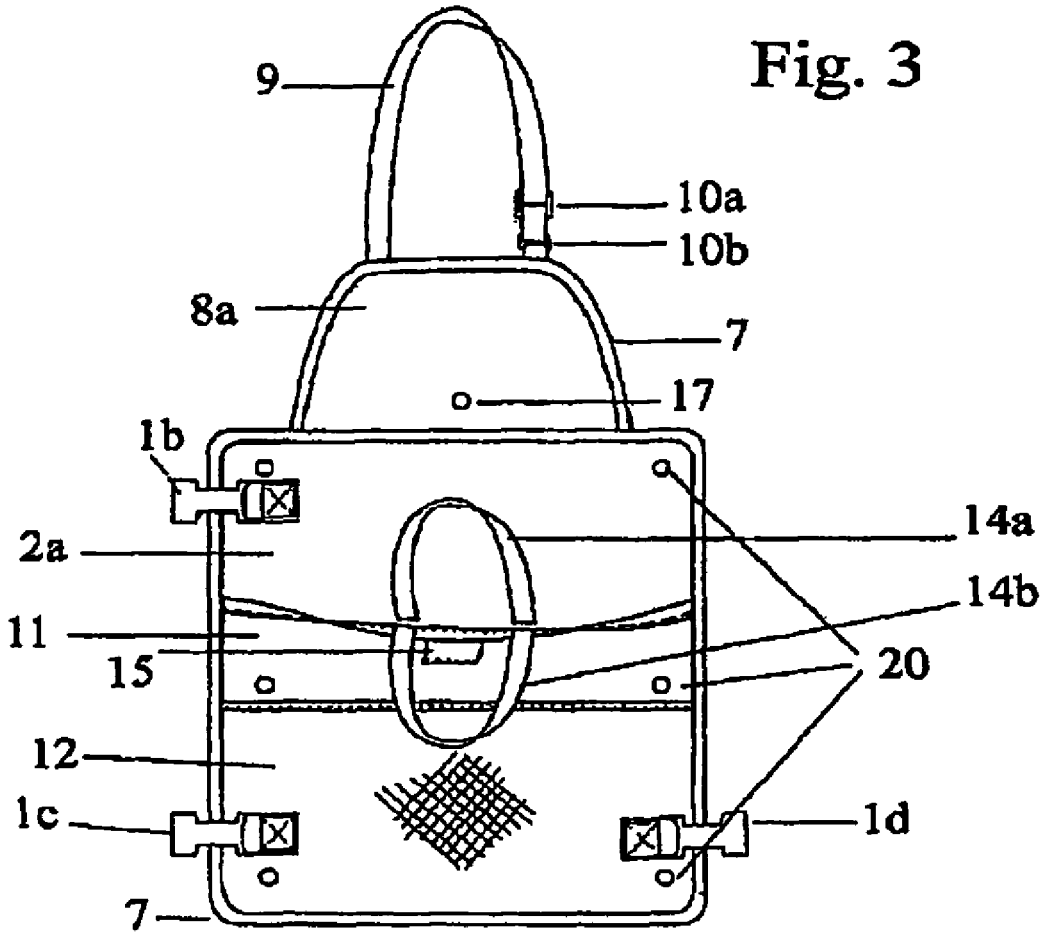
FIG. 3 illustrates another rear view of the garment of the present invention configured for use as an apron, but with additional handles showing.

FIG. 3 show 3 units of releasable couplings 20, attached to panel 2*a*, 11, panel and 12. FIG. 1 show corresponding couplings 19 attached to panel 2 and 18. The purpose of the corresponding releasable couplings 20 and releasable couplings 19 in FIGS. 1 and 2 is to engage each other and hold the storage bag closed as shown in FIG. 10, when the present invention is configured in an overlapping manner to form a storage bag.

Figure 5:
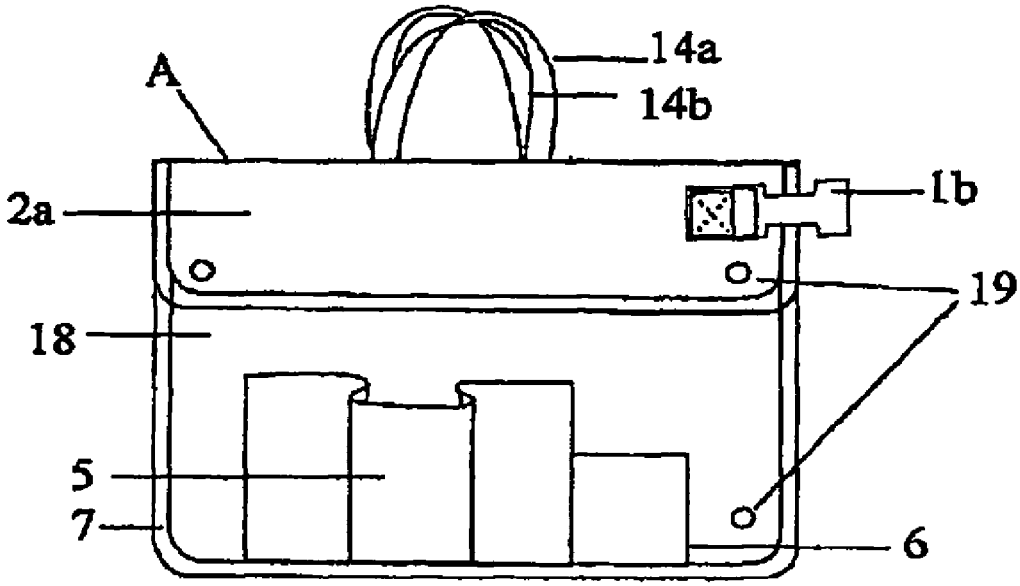
FIG. 5 illustrates a front view of a carry bag according to the present invention.
Figure 6:
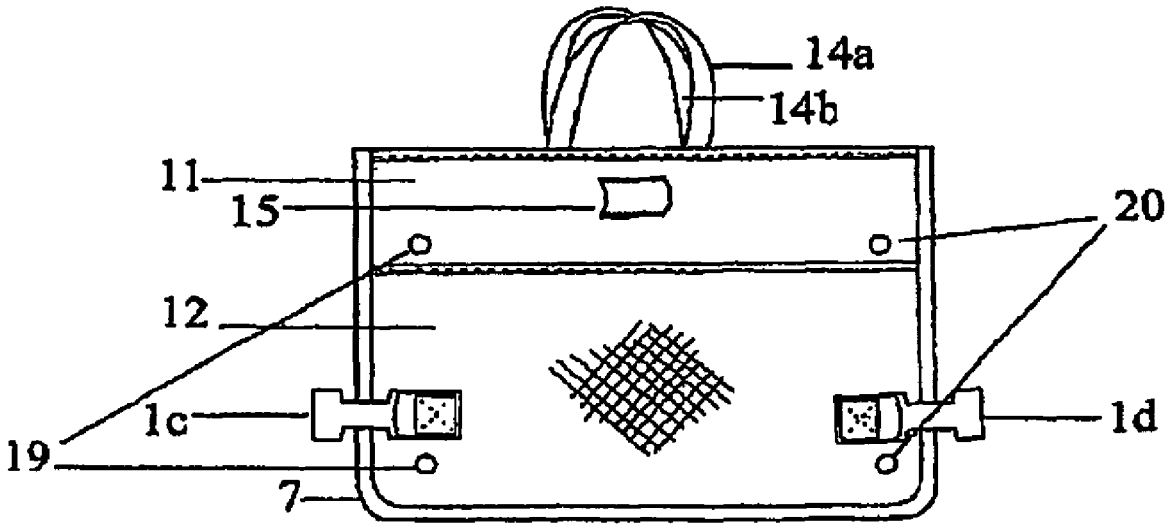
FIG. 6 illustrates a rear view of the carry bag according to the present invention.

As shown in FIG. 3, attached to either or both panel 2*a* and panel 11 is a pair of carry handles 14*a* and 14*b*. These handles are positioned on either side of the pouch formed between panels 2*a* and 11, and which form the carry bag according to the present invention. Thus the positioning of the handles 14*a* and 14*b* is to enable a user to hold the garment or bag so as to carry goods held within the pouch formed between panels 11 and 2*a*. FIGS. 5 and 6 illustrate the carry bag according to the present invention, and which will be described in further detail below.

Figure 4:
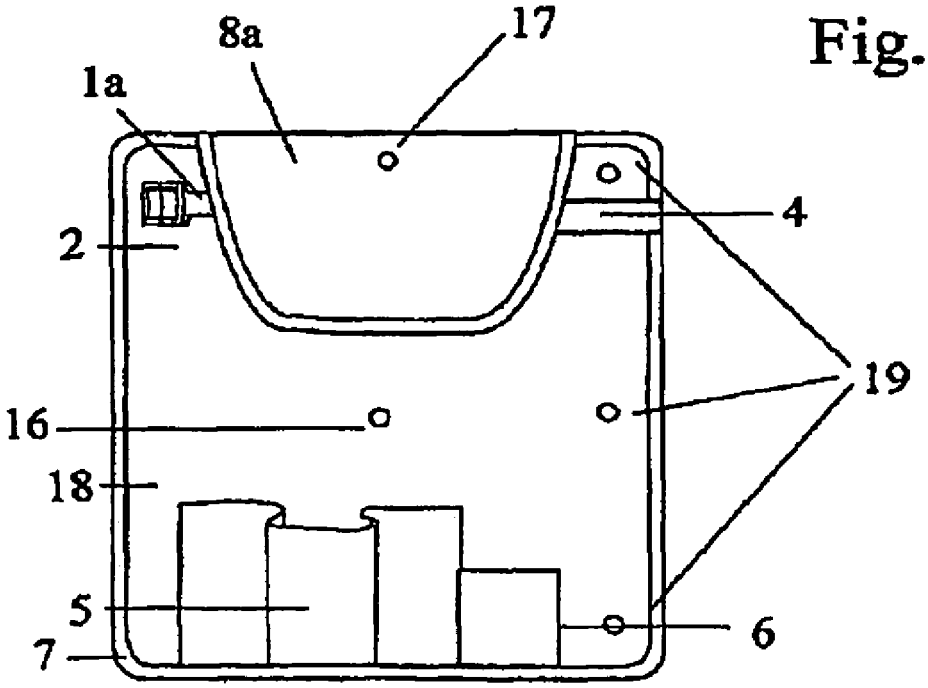
FIG. 4 illustrates a front view of the garment folded in an intermediate position.

In FIG. 4, the bib portion 8*a* is folded toward second portion 2 in an overlapping manner. This forms a waist apron of FIG. 7, or an intermediate position for the garment, in transition between the apron of FIG. 1 and the carry bag of FIG. 5 and storage bag FIG. 10. When the bib portion is further folded over an imaginary line 'A' (as illustrated in FIG. 1 extending proximate the bottom of the second portion 2 where the second portion coupled to the first portion 18) and attached to the first portion 18 by coupling 16 on the body portion 18 and coupling 17 on bib 8*a* a carry bag is formed as illustrated in FIGS. 5 and 6. The purpose of the releasable coupling is to engage each other and hold the bib and second portions in a hold way position as shown in FIG. 5. The bib portion 8*a* is folded in a direction, preferably away from the pouch (not shown) formed by panels 11 and 18 as described above.

The bib 8*a* may be folded or detached from second portion 2, and worn around the waist as an apron, without a bib.

The releasable coupling means 16 and 17 may be used in addition or alternatively to releasably secure the folded front panel.

FIG. 5 illustrates the garment as transformed to a carry bag. The apron bib panel 8*a* as folded as described above in relation to FIG. 4, folds flat onto the first body portion 2 by being folded along imaginary line (A) shown in FIG. 1 proximate the top of panel 11. This folding is performed preferably in the opposition direction from the carry bag pouch formed between panels 11 and 18 as described above. That is, the folded bib portion, and along imaginary line (A), does not form a closure or lid over the pouch formed by panels 11 and 18. Thus, this folding may forms a decorative bag flap to hide and support bib panel 8, neck strap 9, waist strap 4 and/or connection snap 1*a* and/or to expose or enable carry handles 14*a* and 14*b* to be used. In addition the flap may be used as closure or lid for the front pockets 5 and 6 (not shown).

Figure 7:
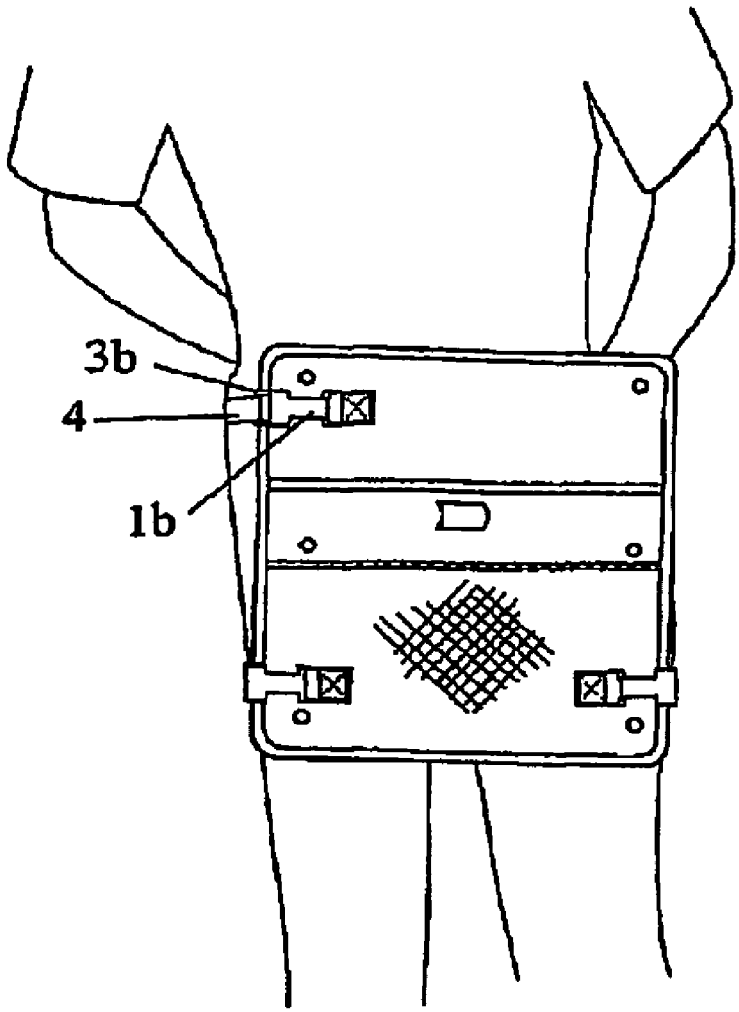
FIG. 7 shows the manner in which the apron may be worn around the waist of a person, with bib folded behind or detached.

FIG. 7 shows the manner, which the apron may be worn reversible around the waist of a person with bib 8 folded behind, or detached. The buckle ends 3*a* and 3*b* may be attached to waist strap 4 as shown in FIG. 1 and may be coupled between snap connections 1*a* and 1*b* of FIG. 2. Connection 1*a* is on the side of the apron facing the person, and thus not visible in FIG. 7.

FIG. 8, there is also shown a loop 15 attached to panel 11 and a pair of snap connection 1*c* and 1*d* attached to panel 12. The purpose of the loop 15 is to hold and support the waist strap 4, and engage the buckle end 3*a* and 3*b* to the snap connection 1*c* and 1*d*. When the buckled end 3*a* and 3*b* is coupled to the snap connection 1*c* and 1*d*, the waist strap 4 providing a means by which, in use, a user can use it as a back shoulder straps as in a backpack.

Figure 9:
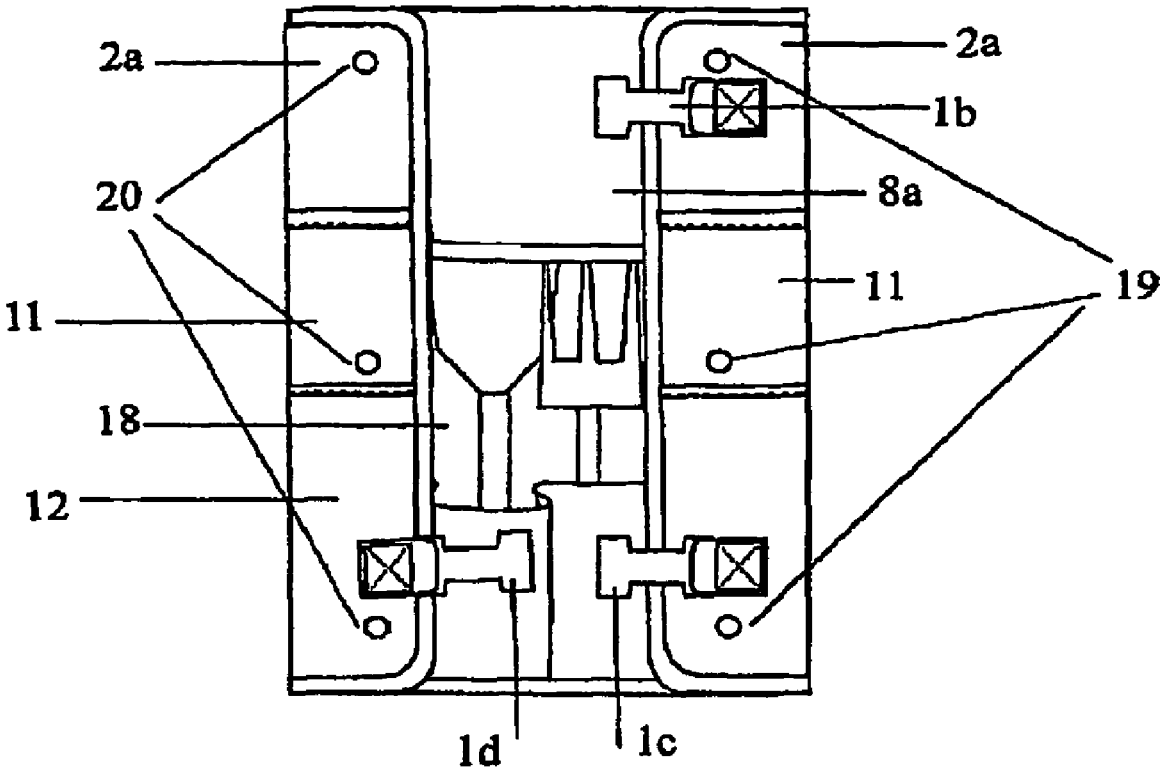
FIG. 9 illustrates the manner in which tools or accessories may be stored and folded upon itself for easy storage as in FIG. 10.

FIGS. 4, 9 and 10 show apron being configured to a storage bag by folding bib 8 toward second portion 2 in an overlapping manner as shown in FIG. 4. Bib 8, second portion 2 and first portion 18 can then be rolled in on themselves (sideways) from left to right (or visa versa) as shown in FIG. 9. By further rolling or overlapping bib 8, first and second portions 18 and 2, fasteners 20 and 19 may be engaged to form a storage bag as shown in FIG. 10. Detachable waist strap 4 with clips 3*a* and 3*b* may engage connection snap 1*b* and 1*c* of the storage bag to form carry strap for comfortably carrying the bag by the user over their shoulder or otherwise as a carry handle.

The garment of the present invention may be made of any suitable material, such as cloth, plastic, nylon, cotton, Hessian, etc.

While this invention has been described in connection with specific embodiments thereof, it will be understood that it is capable of further modification(s). This application is intended to cover any variations uses or adaptations of the invention following in general, the principles of the invention and including such departures from the present disclosure as come within known or customary practice within the art to which the invention pertains and as may be applied to the essential features hereinbefore set forth.

As the present invention may be embodied in several forms without departing from the spirit of the essential characteristics of the invention, it should be understood that the above described embodiments are not to limit the present invention unless otherwise specified, but rather should be construed broadly within the spirit and scope of the invention as defined in the appended claims Various modifications and equivalent arrangements are intended to be included within the spirit and scope of the invention and appended claims. Therefore, the specific embodiments are to be understood to be illustrative of the many ways in which the principles of the present invention may be practiced. In the following claims, means-plus-function clauses are intended to cover structures as performing the defined function and not only structural equivalents, but also equivalent structures. For example, although a nail and a screw may not be structural equivalents in that a nail employs a cylindrical surface to secure wooden parts together, whereas a screw employs a helical surface to secure wooden parts together, in the environment of fastening wooden parts, a nail and a screw are equivalent structures.

"Comprises/comprising" when used in this specification is taken to specify the presence of stated features, integers, steps or components but does not preclude the presence or addition of one or more other features, integers, steps, components or groups thereof."

The invention claimed is:

1. A clothing article, being adapted for multi purpose use, a first use being a bag and a second use being a garment protector, the article comprising:

a first body portion having a pouch adapted, to have goods placed therein, a bib portion having a neck strap adapted for placement around the neck of a user and being adapted to support the article, the bib portion being retractable in a direction towards the first body portion, and a second body portion disposed intermediate the first body portion and the bib portion; and a handle coupling provided on either the first body portion or the second body portion for holding the article when used as a bag.

2. An article as claimed in claim 1, wherein the second body portion and/or the bib portion is retractable by folding the second portion and/or the bib portion over a part of the first portion and wherein the second portion and/or the bib portion is adapted to be releasably coupled to the first body portion when refracted.

3. An article as claimed in claim 2, further comprising coupling means adapted to couple the bib portion to the first body portion when the bib portion is retracted.

4. An article as claimed in claim 2, further comprising coupling means adapted to couple the second portion and the bib portion to the first portion.

5. An article as claimed in claim 1, further comprising one or more additional pockets formed on the first body portion.

6. A clothing article as claimed in claim 1 wherein the handle coupling comprises a pair of carry handles fixed proximate a joint between the first and second body portions.

7. A clothing article as claimed in claim 1 wherein the handle coupling comprises a pair of shoulder straps adapting the article for use a backpack.

8. An article as claimed in claim 1, further comprising one or more additional pockets formed on the first body portion.

9. An article as claimed in claim 1, further comprising an additional portion forming a pouch wherein the additional portion is attached to the first body portion.

10. An article as claimed in claim 9, further comprising one or more further pockets formed on the additional portion.

11. An article as claimed in claim 9, wherein the handle coupling comprises a first handle provided on the first portion and a second handle provided on the additional portion.

12. An article as claimed in claim 2, wherein the article is adapted for a third use being a storage bag, and further comprises coupling means associated with an additional panel and adapted to be releasably fastened together to facilitate the article being formed into a storage bag, and a strap.

13. An article as claimed in claim 2, wherein the article is adapted for a use as a back-pack, and further comprises coupling means associated with an additional portion and a strap, the additional portion forming the pouch wherein the additional portion is attached to the first body portion.

14. An article as claimed in claim 1, wherein the article is an apron.

15. An article as claimed in claim 1, wherein the article is a carry bag.

16. An article as claimed in claim 1, wherein the article is a storage bag.

17. An article as claimed in claim 1, wherein the article is a backpack.

18. A method of transforming an article of clothing being a garment protector into a carry bag, the method comprising the steps of:

providing an article having a first body portion having a pouch adapted, in use, to have goods placed therein, the article further comprising a bib portion and a second body portion disposed intermediate the first body portion and the bib portion;

retracting the bib portion and the second body portion toward the first body portion;

releasably securing the bib portion to the first body portion; and retracting and releasably securing the bib portion exposing a handle coupling provided on either the first body portion or the second body portion for carrying the article in the form of a bag.

19. A method as claimed in claim 18, wherein exposing the handle coupling exposes a first handle on the first body portion and a second handle on an additional portion, the additional portion being attached to the first body portion and forming the pouch.

20. A method as claimed in claim 18, wherein retracting the bib portion and the second body portion comprises folding the bib portion in a direction towards from the first body portion.

21. A method as claimed in claim 18, wherein retracting the bib portion and the second body portion comprises folding the second body portion in a direction towards the first body portion.

22. A method as claimed in claim 18, wherein the method further comprises the steps of:

forming a storage bag by fastening together coupling means provided on the first body portion.

23. An method as claimed in claim 18, wherein the article comprises coupling means and a strap, the method comprising the steps of forming a back-pack by fastening the strap to the coupling means.

24. A multi-purpose article having a first use as a garment protector, the article comprising:

a body portion and a bib portion, the bib portion having a strap for placement around a neck of a user such that in a first use as a garment protector the bib portion covers a front portion of a chest of the user with the body portion extending below the bib portion, the body portion having a first body portion and a second body portion, the second body portion disposed intermediate the first portion and bib portion, the second body portion allowing the bib portion to be retracted towards the body portion and the bib portion to be folded to dispose the bib portion between portions of the body portion and secured to form a bag, as the second use, wherein the second body portion allows the bib portion to be retracted towards the body portion and bib and second body portions to be folded with the bib portion between the first body portion and the second body portion and secured to form a bag, as the second use.

* * * * *